US005490292A

United States Patent [19]

Auburn

[11] Patent Number: 5,490,292

[45] Date of Patent: Feb. 13, 1996

[54] COT

[76] Inventor: David M. Auburn, 9762 W. Ken Caryl Dr., Littleton, Colo. 80127

[21] Appl. No.: 29,139

[22] Filed: Mar. 10, 1993

[51] Int. Cl.[6] ..... A47C 19/00; A47C 21/00

[52] U.S. Cl. ..... 5/8; 5/400; 5/401; 5/498; 5/510; 5/655

[58] Field of Search ..... 5/400, 401, 402, 5/420, 498, 8, 10, 510, 655

[56] References Cited

U.S. PATENT DOCUMENTS

| | | | |
|---|---|---|---|
| 2,672,628 | 3/1954 | Spanel . | |
| 2,751,268 | 6/1956 | Creelman | 5/420 |
| 2,876,020 | 6/1959 | Murchie | 5/510 |
| 3,732,585 | 5/1973 | Krehbiel | 5/400 |
| 3,835,482 | 9/1974 | Tersch | 5/420 |
| 4,234,977 | 11/1980 | Snow . | |
| 4,250,580 | 2/1981 | Eichenaver . | |
| 4,522,381 | 6/1985 | Ludwick | 5/655 |
| 4,530,123 | 7/1985 | Mathou . | |
| 4,583,252 | 4/1986 | McCourt | 5/110 |
| 4,745,643 | 5/1988 | Clarke | 5/8 |
| 4,756,042 | 7/1988 | Genovese . | |
| 4,935,973 | 6/1990 | Behrman | 5/655 |
| 4,964,183 | 10/1990 | LaForce, Jr. | 5/421 |
| 5,092,010 | 3/1992 | Wong | 5/498 |
| 5,203,041 | 4/1993 | Alonso | 5/420 |

FOREIGN PATENT DOCUMENTS

| | | | |
|---|---|---|---|
| 941445 | 4/1956 | Germany | 5/110 |

OTHER PUBLICATIONS

Kiddy Kot Product Brochure, Apr. 1979.

EC classroom furnishings catalog pp. 10–13 admitted prior art.

Cots & Accessories catalog 3 pgs. admitted prior art.

*Primary Examiner*—Michael J. Milano

[57] ABSTRACT

A one piece rotationally molded cot for toddlers and other individuals includes a recessed sleeping surface supported above a raised bottom wall by a plurality of upwardly extending pillars. A closed dead air space between the bottom wall and sleeping surface and an additional air space beneath the bottom wall and above the room floor provide insulation for warmth. The cots nest in stacked relation for storage in minimum space. Dollies configured for conforming engagement beneath head and foot ends of the cots include swivel casters to facilitate transportation. Accessory items for use with the cot include a foam pad receivable in a fabric pad cover, a mattress, and a sheet. Cooperating VELCRO (™) fasteners secure the cover to the cot and the sheet to the mattress.

20 Claims, 5 Drawing Sheets

232
230
234
212
218
220
214
208
216
210
202
204
200
16
206
18
10
130
131
131
129
130
100
100
129

COT

BACKGROUND OF THE INVENTION

1. Field of the Invention

The present invention relates to cots, and more particularly pertains to an improved cot particularly adapted for use by toddlers in day care centers and also by adults and other individuals in refugee shelters, camps, or similar facilities. Day care centers typically employ cots for use by small children taking daily naps. Cots serve the purpose of supporting children above cold and dirty room floors, and additionally provide a regular sleeping environment which promotes organized and scheduled napping. Important considerations for such cots include low cost, convenient transportation and storage, durability, and ease of cleaning and sanitizing. The cot must also provide a warm, safe, and comfortable sleeping surface for small children and other individuals.

2. Description of the Prior Art

Prior art cots typically include a wood, steel, or aluminum frame with a cloth cover stretched thereover. Such cots are difficult to store and clean. U.S. Pat. No. 4,234,977 issued on Nov. 25, 1980 to B. Snow discloses a one piece cot vacuum molded from a thin sheet of plastic and including a recessed contoured sleeping surface spaced above outwardly extending floor contact flanges. A plurality of the one-piece molded cots may be stacked for storage. The cot disclosed by Snow possesses exposed flange edges which create the potential for injury to small children and other individuals and also separates the sleeping surface from the typically cold floor surface by only an open air space. Due to the open bottom construction, the cot disclosed by Snow possesses limited structural rigidity and load bearing capacity. Further, the cot of Snow does not provide for the convenient securement of accessory linen items nor is it susceptible of manufacture by a rotational molding process. The vacuum molding process employed in forming the cot of Snow results in stress points in the finished cots where the plastic sheet stock material is deformed to conform with the die. In use, the stress points fracture, creating cracks which pinch and cut a user's skin.

SUMMARY OF THE INVENTION

In order to overcome the disadvantages of prior art cots and to achieve other objects of the invention set forth herein, the present invention provides a one piece rotationally molded improved cot for toddlers and other individuals which includes a recessed sleeping surface supported above a raised bottom wall by a plurality of upwardly extending pillars. A closed dead air space between the bottom wall and sleeping surface and an additional air space beneath the bottom wall and above the room floor provide insulation for warmth. The cots nest in stacked relation for storage in minimum space, while maximizing useable sleeping surface area. Dollies configured for conforming engagement beneath head and foot ends of the cots include swivel casters to facilitate transportation. Accessory items for use with the cot include a foam pad receivable in a fabric pad cover, a mattress, and a sheet. Cooperating VELCRO (™) fasteners secure the cover to the cot and the sheet to the mattress.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
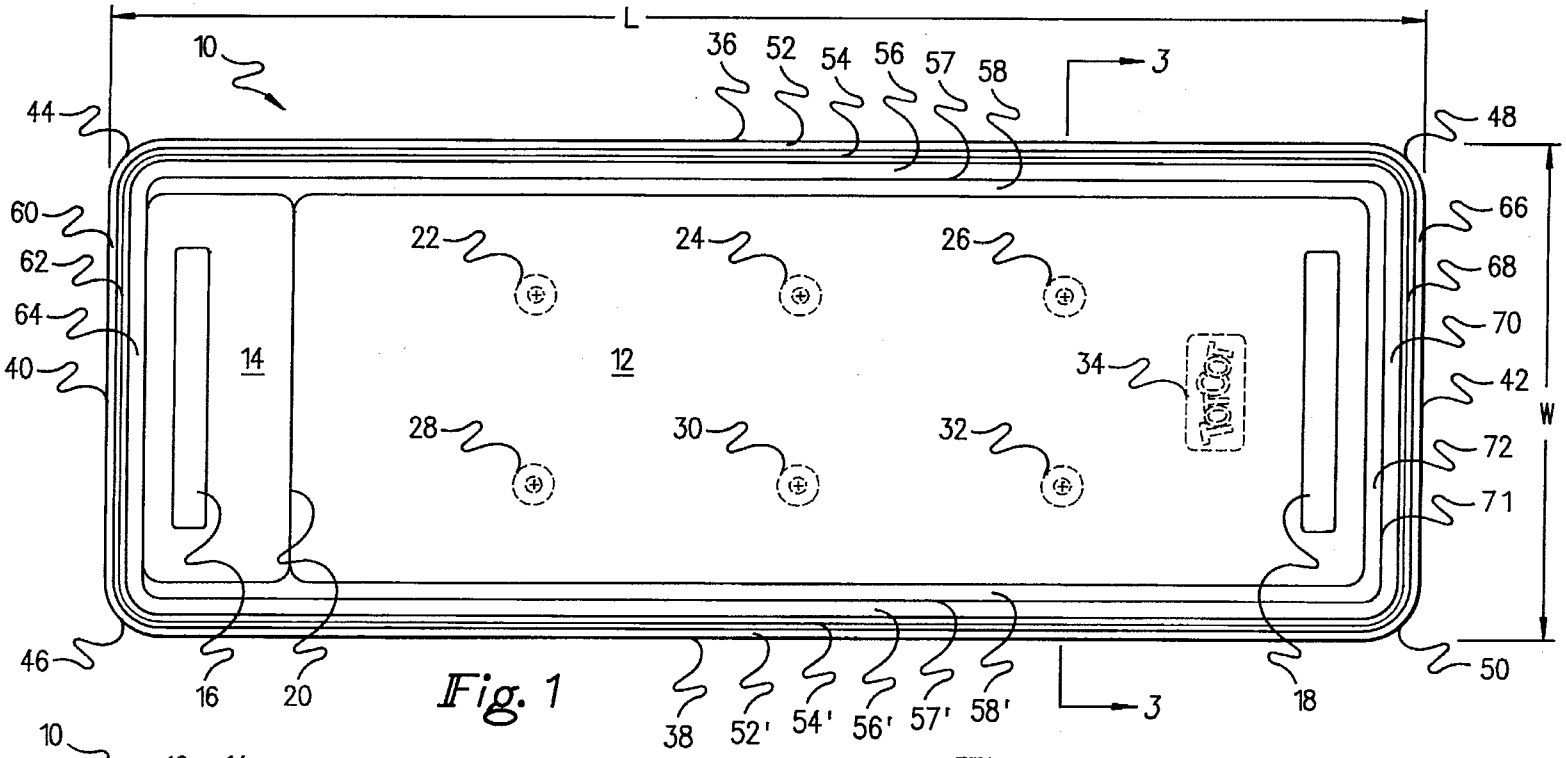
FIG. 1 is a top plan view of the cot according to the present invention.
Figure 2:
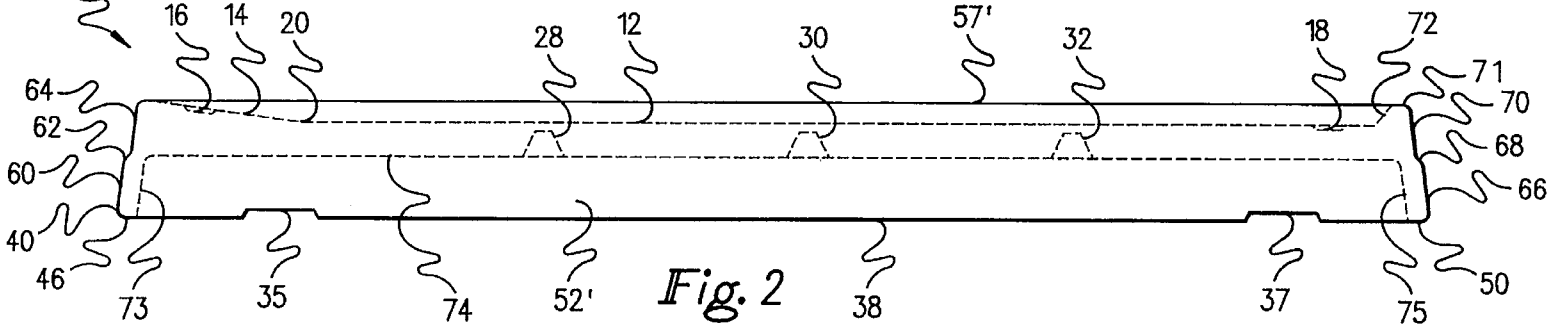
FIG. 2 is a side elevational view of the cot according to the present invention.
Figure 3:
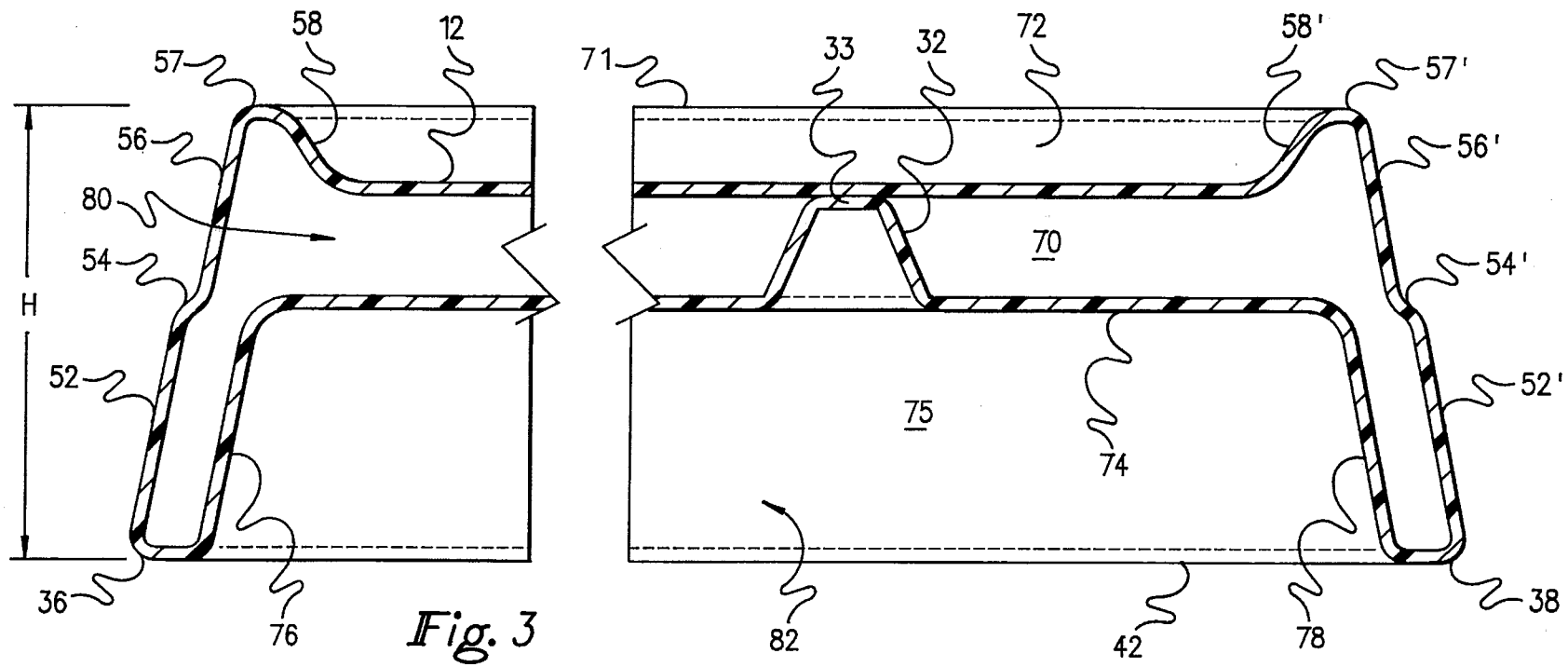
FIG. 3 is a transverse cross sectional view taken along line 3—3 of FIG. 1.

Referring now to the drawings, wherein like reference numerals designate corresponding structure throughout the views, and referring in particular to FIGS. 1, 2, and 3, an improved cot 10 according to a preferred embodiment of the invention dimensioned for use by toddlers possesses a generally rectangular shape, with a preferred length L of about 48 inches, width W of about 21 inches, and height H of about 4.25 inches. Within the scope of this disclosure and the appended claims, the term "cot" is used in a broad sense to include both temporary and permanent small and full size beds designed for supporting a resting or sleeping human or animal. The cot 10 may be formed in a wide variety of different sizes for use by different individuals. For example, a cot for use by adults may be about 2 meters in length and about 0.75 meters in width. The cot 10 is preferably one piece, and rotationally molded from a somewhat resilient, fire retardant plastic material such as linear low density polyethylene of the type designated in the industry as EXXON 8556.67 or the equivalent. As a higher production alternative to rotational molding, a blow molding process in which the walls of an extruded heated plastic tube are blown outwardly against suitably formed mold surfaces to form the cot may also be employed without departing from the scope of the present invention. The cot 10 includes a recessed substantially planar sleeping surface 12 intersecting an inclined head rest surface 14 along a transverse intersection 20. Elongated rectangular recessed zones 16 and 18 disposed adjacent head and foot ends of the cot, respectively, receive pile fastener strips of the type sold under the trademark VELCRO for the purpose of securing a fabric pad cover to be described subsequently. A plurality of frusto conical pillars 22, 24, 26, 28, 30, and 32 extend upwardly in three spaced transversely aligned pairs from a raised bottom wall 74. As shown in FIG. 3, each of the pillars, for example pillar 32, includes a flat circular top surface 33 disposed in abutment with the bottom face of the sleeping surface 12, thus providing additional and substantially uniform support. The flat top surfaces of the pillars may be initially spaced slightly below the sleeping surface 12, such that an individual's weight causes abutment.

A rectangular slightly recessed indicia zone 34 on the sleeping surface 12 adjacent the foot end of the cot 10 includes integrally molded indicia, for example a trademark, company name, model designation, etc.

The cot 10 includes opposite longitudinal bottom edge portions 36 and 38 adapted to rest on the surface of a room floor. As shown in FIG. 2, hand grip notches 35 and 37 may be provided in the longitudinal bottom edge portions to facilitate lifting of the cot 10. Preferably, four such notches are provided in laterally aligned pairs, with two notches in each of the two opposite longitudinal bottom edge portions 36 and 38. The notches may be about 0.5 inches in height and 4 inches long. Opposite end edge portions 40 and 42 connect longitudinal bottom edge portions 36 and 38 via 90 degree radius corners 44, 46, 48, and 50. The construction of both of the longitudinal sides of the cot is symmetrical, and thus identical reference numerals differentiated by a prime symbol (') have been employed to designate corresponding elements. The bottom edge portions 36 and 38 are defined by a 180 degree radius bend of a single sheet of material resulting from a rotational molding process. Thus, no sharp, rough, or straight edges exist to create the potential for injury to individuals or mar floors. Lower exterior side wall portions 52, 52' incline upwardly and slightly inwardly (about 11 degrees from vertical) to a radiused shoulder intersection 54, 54' with an upper exterior side wall portion 56, 56' also preferably inclined about 11 degrees from vertical. The opposite upper side wall portions 56 and 56' each terminate at a radiused bend 57, 57' terminating in a downwardly and inwardly inclined inner upper side wall portion 58, 58'. Inner upper side wall portions 58, 58' merge smoothly with planar sleeping surface 12, providing peripheral support for the sleeping surface 12 along the longitudinal side edges.

The head end of the cot 10 includes an upwardly and inwardly inclined lower head end wall portion 60 which intersects an upwardly and inwardly inclined upper head end wall portion 64 along a radiused shoulder 62. The foot end of the cot 10 similarly possesses an upwardly and inwardly inclined lower foot end wall portion 66 which intersects an upwardly and inwardly inclined upper foot end wall portion 70 along a radiused shoulder 68. The upper foot end wall portion 70 terminates at a radiused bend 71 which merges with sleeping surface 12 via downwardly and inwardly inclined inner upper foot wall portion 72.

As shown in FIGS. 2 and 3, the lower portion of the cot 10 possesses a double wall construction which includes interior lower foot end wall 75 connecting opposite lower interior side walls 76 and 78. Lower interior foot end wall 75 and an opposite symmetrical lower interior head end wall 73 (FIG. 2), in conjunction with raised bottom wall 74 and interior side walls 76 and 78, defines an open-bottomed recess 82 which serves two purposes. First, the recess 82 is dimensioned to receive an upper portion of another identical cot 10, such that a plurality of cots 10 may be stored in stacked nested relation in a minimum amount of space. In this context, the bottom edges of each stacked cot rest upon the peripheral side wall and end wall radiused shoulders of the cot below. Second, the recess 82 provides an insulating air space between the sleeping surface 12 and the typically cold room floor upon which the cot is disposed. By virtue of the closed curve construction of the rotationally molded cot 10, an entirely closed additional insulating air space 80 is defined between the sleeping surface 12, the raised bottom wall 74, and the side and end wall surfaces. As can be best appreciated with reference to FIG. 3, the vertically spaced air spaces 80 and 82 form dual insulating layers, analogous to the air spaces of a triple pane window. This construction minimizes heat transfer from an individual sleeping on surface 12 to ambient, as compared with conventional cots.

The closed curve construction of the cot 10 allows formation through a rotational molding process in which a mold cavity possessing bounding wall surfaces conforming to the walls of the cot is initially partially filled with a dry plastic resin powder. The mold is then heated to melt the powder and rotated spherically, i.e., simultaneously rotated about two perpendicular central axes of a sphere, such that centrifugal and gravitational forces uniformly distribute or "paint" the liquid resin on the bounding wall surfaces of the mold cavity. The mold is then cooled while rotating to form the finished cot. Thus, the wall thickness of the finished cot is not determined by any predetermined mold dimension, as in injection molding, but rather upon the quantity of resin powder utilized to initially charge the mold. Additionally, since no stretching or deformation of a stock material is involved, the rotational molding process does not produce stress points or zones which weaken the resulting article. The rotational molding process is a known process generally, but its application to the field of cots enabled by the novel cot design of the present invention was heretofore unknown. U.S. Pat. No. 4,756,042, which issued to Vincent P. Genovese et al. on Jul. 12, 1988, the entire disclosure of which is hereby incorporated herein by reference, discloses the use of a rotational molding process to form a one piece housing of a floor polishing machine.

In an alternative construction, a plurality of integral, extensible, or separate selectively attachable legs (not shown) may be provided to support the cot 10 at a greater elevation above a floor or ground surface. Such legs would preferably detach, retract, or fold so as not to interfere with stacking.

Figure 4:
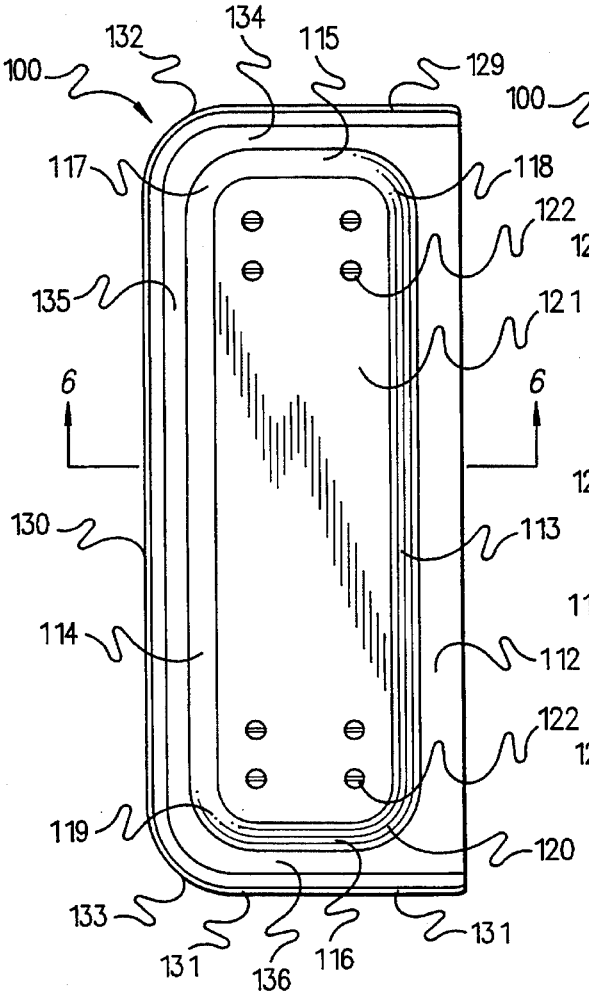
FIG. 4 is a top perspective view illustrating a dolly for facilitating transportation and storage of the cot according to the present invention.
Figure 5:
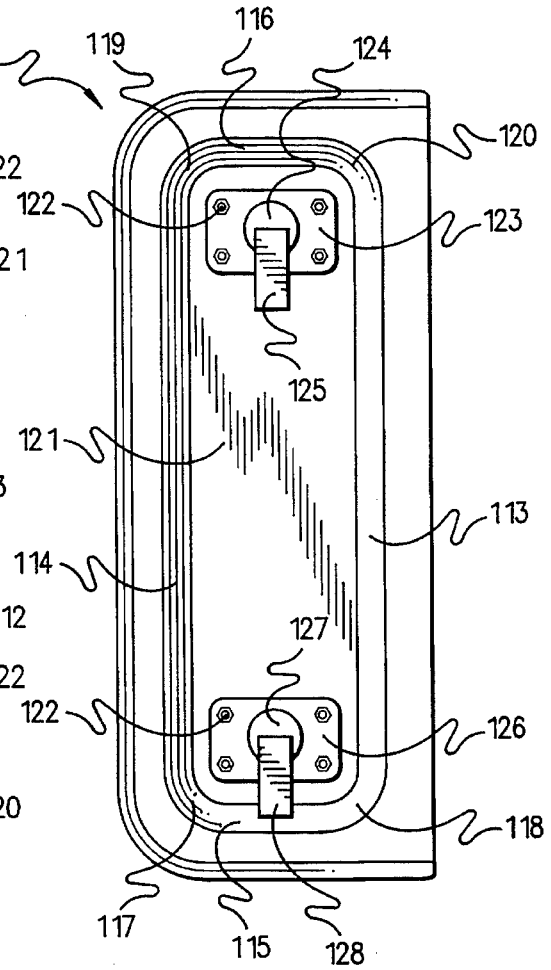
FIG. 5 is a bottom perspective view illustrating the dolly of FIG. 4.
Figure 6:
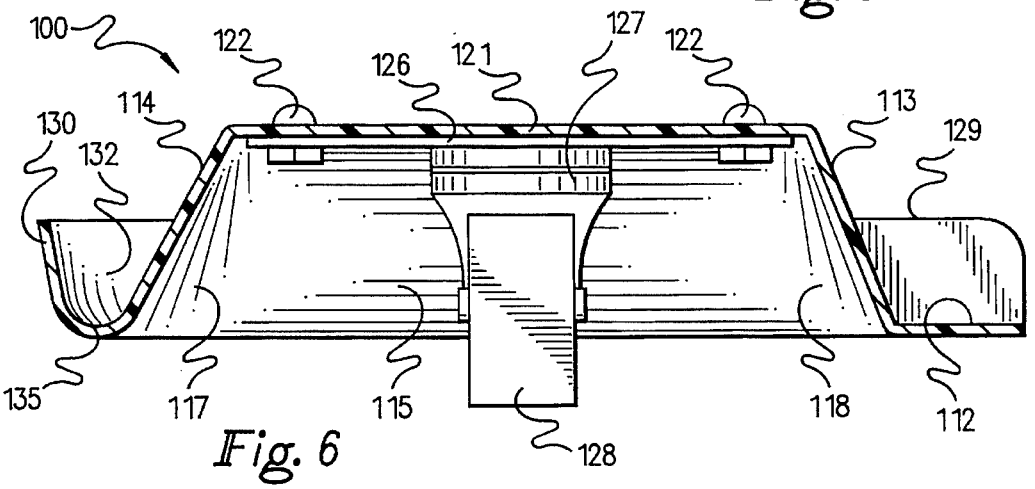
FIG. 6 is a transverse cross sectional view taken along line 6—6 of FIG. 4.
Figure 7:
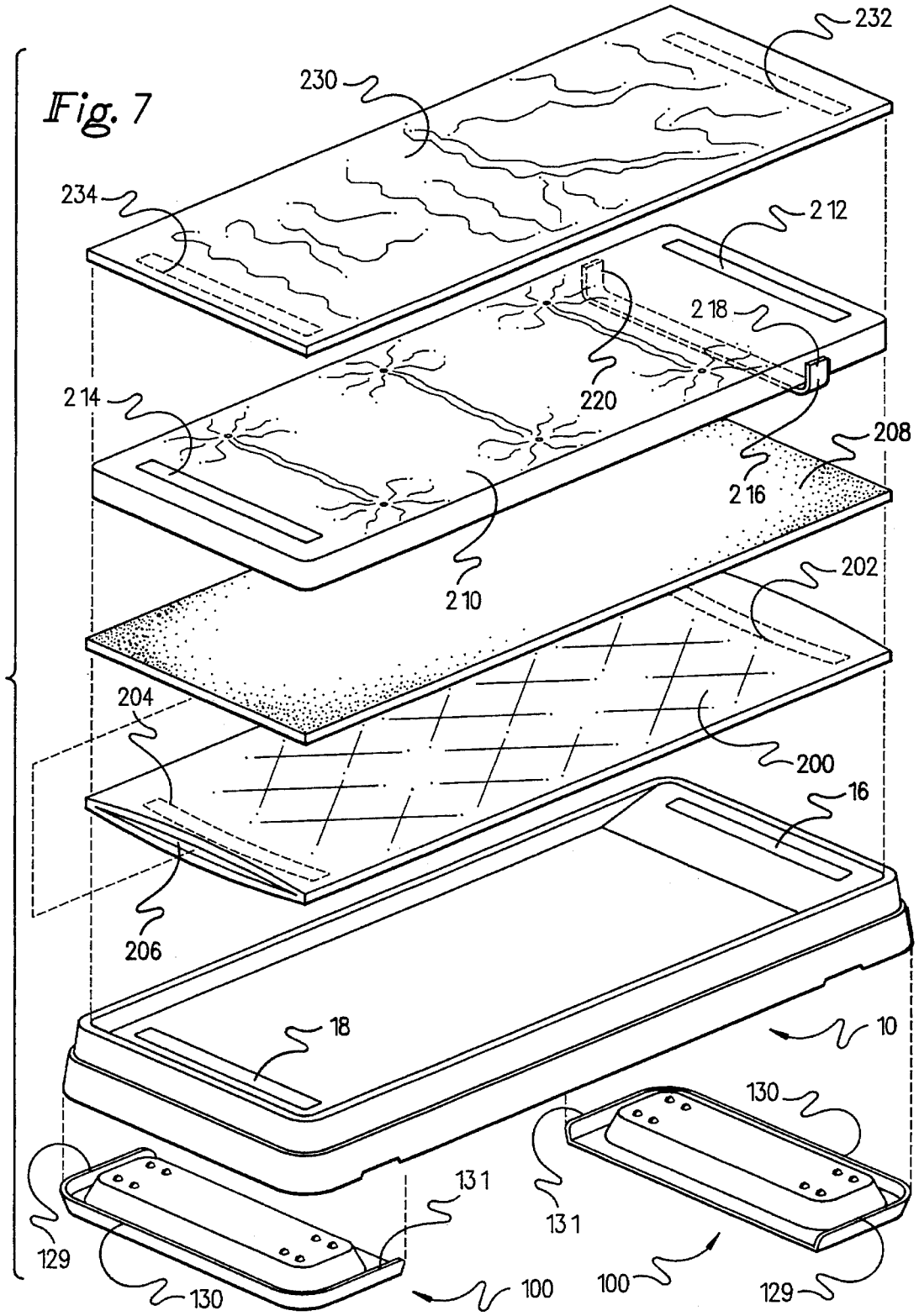
FIG. 7 is an exploded perspective view illustrating the cot according to the present invention along with dolly, pad, pad cover, mattress, and sheet accessory components.

With reference to FIGS. 4, 5, and 6, a dolly 100 for the cot 10 of the present invention includes a substantially planar floor 112 from which opposite side walls 113 and 114 and opposite end walls 115 and 116 incline upwardly and inwardly to intersections with a raised planar caster mounting surface 121. Dolly 100 is preferably molded from a ⅜ inch thick, high impact ABS plastic material. As shown in FIG. 2, a plurality of conventional fasteners such as bolts and nuts secure a pair of mounting plates 123 and 126 at opposite ends of the underside of caster mounting surface 121. Swivel bearing assemblies 124 and 127 secure 2 inch diameter caster wheels 125 and 128 in a conventional manner to mounting plates 123 and 126. Side walls 129, 130, and 131 connected by radiused corners 132 and 133 extend upwardly from floor 112 and define respective channels 134, 135, and 136 dimensioned to receive lower side and end wall portions of the cot 10. Inclined wall surfaces 114, 115, and 116 are dimensioned and disposed for engagement with the inclined lower interior side 76, 78 and end 73, 75 wall surfaces of the cot 10, with the top face of caster mounting surface 121 disposed slightly below the bottom side of raised bottom wall 74. (FIG. 3). As shown in FIG. 7, a pair of identical dollies 100 may be nested within opposite end portions of a cot 10, such that side walls 129, 130, and 131 partially overlie lower exterior wall portions of the cot 10. In this manner a plurality of stacked cots 10 may be easily rolled to and from a storage location.

To enhance comfort, a plurality of preferred linen accessory items may be employed in conjunction with the cot 10. As depicted in FIG. 7, a fabric pad cover or envelope 200 includes a lower face provided at opposite ends with hook and loop type pile fasteners (VELCRO™) 202 and 204 disposed and dimensioned for engagement with cooperating fasteners 16 and 18 on cot 10 for the purpose of releasably securing the fabric pad cover 200 in position. The cover 200 is preferably made from a cotton and polyester cloth. An elastomeric closed cell ½ inch thick rectangular foam pad 208 of a conventional construction is dimensioned for removable insertion through an open end 206 of the cover 200. Suitable conventional fasteners such as VELCRO (™), snaps, zippers, etc. may be provided for selectively closing the opening 206. A quilted mattress 210 possesses an upper surface provided at opposite ends with hook and loop pile fasteners (VELCRO™) 212 and 214 adapted for releasable engagement with cooperating fasteners 232 and 234 disposed at opposite ends on an underside of a fabric sheet 230. Thus, both the pad cover 200 and the sheet 230 may be easily removed for machine washing. Alternatively, the mattress 210 may be secured directly to the cot 10 by engaging fasteners 232 and 234 to cooperating fasteners 16 and 18. The mattress 210 is preferably formed from a cotton and polyester fabric filled with polyester fiber.

Figure 8:
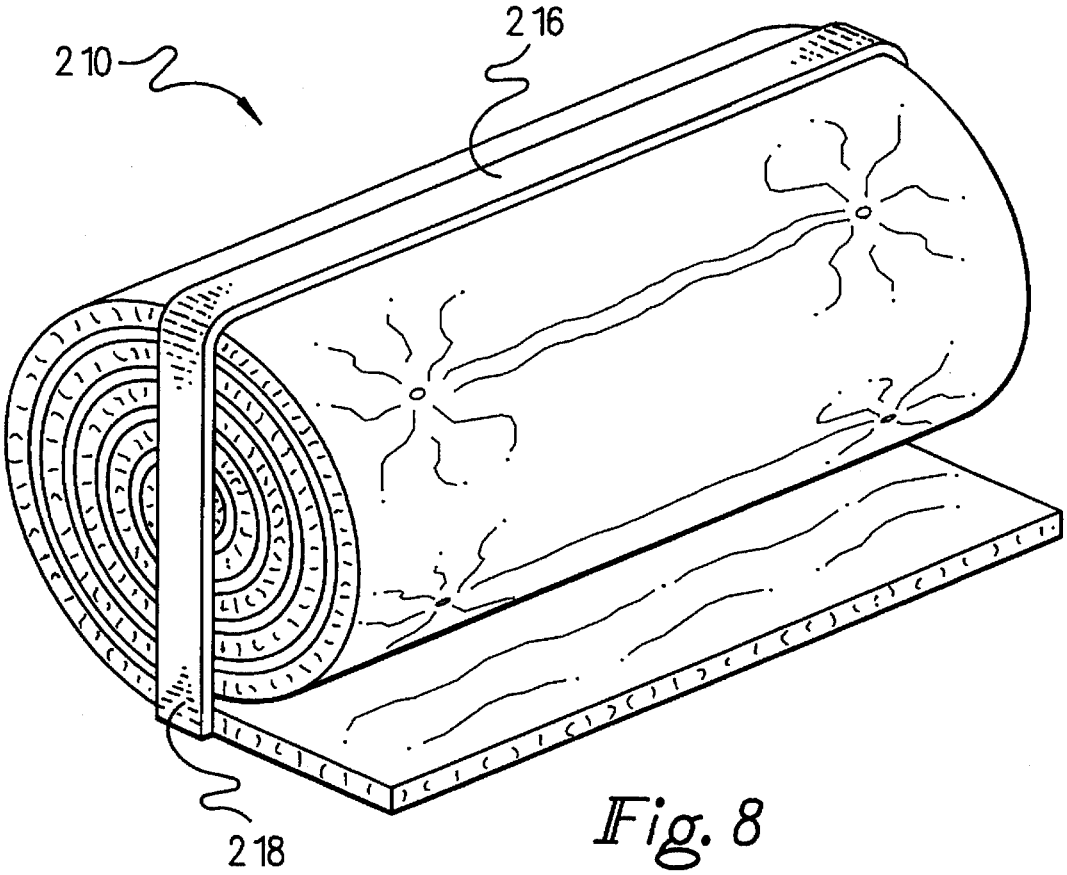
FIG. 8 is a perspective view illustrating the mattress accessory component disposed in a rolled condition for transportation.

As shown in FIGS. 7 and 8, the mattress 210 preferably includes a laterally extending elastic band 216 sewn to the mattress 210 at opposite medial side portions 218 and 220. The band 216 serves to retain the mattress in a rolled storage condition as shown in FIG. 8. This allows each individual's personal mattress and sheet to be easily transported home for washing while the remainder of the cot and accessory items are left at the day care center, shelter, or other facility.

As may now be readily appreciated, the present invention provides an inexpensive, one piece, rotationally molded improved cot and accessory items which may be provided in a variety of ornamental colors and designs, allows for convenient transportation and storage, facilitates cleaning and sanitizing, and affords enhanced warmth and comfort to users.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A cot, comprising:

an elongated substantially hollow body possessing a closed curve construction, said hollow body rotationally molded from a plastic material;

said body including a substantially planar sleeping surface intersecting an inclined head rest portion;

a substantially enclosed insulating air space formed within said body beneath said sleeping surface;

a second insulating air space disposed beneath said enclosed insulating air space and adapted to separate said enclosed insulating air space from a floor supporting said cot;

a raised bottom wall at least partially defining said enclosed insulating air space;

at least one pillar extending upwardly from said raised bottom wall for supporting said sleeping surface;

said body including a top portion and a recessed bottom portion dimensioned to receive said top portion such that a plurality of identical cots may be stored in nested stacked relation;

said top and bottom portions at least partially defined by a separating peripherally extending shoulder;

at least one dolly including at least one rotatable element dimensioned for engagement with said cot to facilitate transportation and storage;

said at least one dolly dimensioned for at least partial nesting within said recessed bottom portion;

said at least one dolly including channel portions dimensioned for at least partial insertion of bottom edges of said cot and said dolly further including side walls dimensioned to at least partially overlie side wall portions of said cot;

a pad;

a cover for said pad;

cooperating fasteners on said cover and said cot for releasably securing said cover and pad to said cot;

a mattress;

cooperating fasteners on said mattress and said cot for releasably securing said mattress to said cot;

a laterally extending elastic strap on said mattress for securing said mattress in a rolled condition for transportation and storage;

a sheet; and means for securing said sheet to said mattress.

2. A cot, comprising:

an elongated substantially hollow single piece integral body comprising a self-supporting plastic material possessing a double-wall closed curve cross-sectional construction.

3. The cot of claim 2, further comprising:

a sleeping surface; and a substantially enclosed insulating air space formed within said body beneath said sleeping surface.

4. The cot of claim 3, further comprising a second insulating air space disposed beneath said enclosed insulating air space and adapted to separate said enclosed insulating air space from a floor supporting said cot.

5. The cot of claim 3, further comprising a raised bottom wall at least partially defining said enclosed insulating air space.

6. The cot of claim 5, further comprising at least one pillar extending upwardly from said raised bottom wall for supporting said sleeping surface.

7. The cot of claim 2, wherein said cot includes a substantially planar sleeping surface intersecting an inclined head rest portion.

8. The cot of claim 2, wherein said body includes a top portion and a recessed bottom portion dimensioned to receive said top portion in nested stacked relation within said bottom portion for storing a plurality of identical cots in nested stacked relation.

9. The cot of claim 2, wherein said cot includes top and bottom portions at least partially defined by a separating peripherally extending shoulder.

10. The cot of claim 2, further comprising at least one dolly including at least one rotatable element;

said body including a recessed bottom portion and said at least one dolly dimensioned for at least partial nesting within said recessed bottom portion to facilitate transportation and storage.

11. The cot of claim 10, wherein said dolly includes channel portions dimensioned for at least partial insertion of bottom edges of said cot.

12. The cot of claim 11, wherein said dolly includes side walls bounding said channel portions dimensioned to at least partially overlie side wall portions of said cot.

13. The cot of claim 2, further comprising:

at least one recessed zone on said body; and a fastening strip disposed within said recessed zone for releasably securing a linen accesory item to said body.

14. The cot of claim 13, wherein said linen accessory item comprises a mattress including a laterally extending elastic strap for securing said mattress in a rolled condition for transportation and storage.

15. A cot, comprising:

an elongated, substantially rectangular, single piece integral body comprising a self-supporting plastic material;

said body including a bottom portion having lower side wall portions with bottom edges adapted for abutment with a room floor, said lower side wall portions slightly inclined upwardly and inwardly from said bottom edges;

said body including a top portion having upper side wall portions, said lower side wall portions intersecting said upper side wall portions at a shoulder extending at least partially around a perimeter of said body;

said upper side wall portions substantially surrounding a substantially rectangular sleeping surface recessed below top edges of said upper sidewall portions;

said bottom portion having a substantially hollow interior, and said top portion dimensioned for receipt within said hollow interior of said bottom portion for storing a plurality of identical cots in nested stacked relation such that the bottom edges of said lower side wall portions of each stacked cot rest at least partially upon said shoulder of the cot below; and said sleeping surface disposed above said shoulder in said top portion of said body such that said hollow interior of said bottom portion forms, upon abutment with a room floor, a substantially enclosed insulating air space beneath said sleeping surface.

16. A cot, comprising:

an elongated body comprising a self-supporting material;

said body including a bottom portion having lower side wall portions with bottom edges adapted for abutment with a room floor;

said body including a top portion having upper side wall portions, said lower side wall portions intersecting said upper side wall portions at a shoulder extending at least partially around a perimeter of said body;

said upper side wall portions substantially surrounding a sleeping surface recessed below top edges of said upper sidewall portions;

said bottom portion having a substantially hollow interior, and said top portion dimensioned for receipt within said hollow interior of said bottom portion for storing a plurality of identical cots in nested stacked relation; and said hollow interior of said bottom portion forming, upon abutment with a room floor, a substantially enclosed insulating air space beneath said sleeping surface.

17. A cot, comprising:

an elongated substantially hollow single piece integral body comprising a self-supporting plastic material having a double-wall closed curve cross-sectional construction;

said body including a bottom portion having lower side wall portions with bottom edges adapted for abutment with a room floor;

said body including a top portion having upper side wall portions, said lower side wall portions intersecting said upper side wall portions at a shoulder extending at least partially around a perimeter of said body;

said upper side wall portions substantially surrounding a sleeping surface;

said bottom portion having a substantially hollow interior, and said top portion dimensioned for receipt within said hollow interior of said bottom portion for storing a plurality of identical cots in nested stacked relation; and said hollow interior of said bottom portion forming, upon abutment with a room floor, a substantially enclosed insulating air space beneath said sleeping surface.

18. A cot, comprising:

an elongated body comprising a self-supporting material;

said body including a bottom portion having lower side wall portions with bottom edges adapted for abutment with a room floor;

said body including a top portion having upper side wall portions, said lower side wall portions intersecting said upper side wall portions at a shoulder extending at least partially around a perimeter of said body;

said upper side wall portions substantially surrounding a sleeping surface;

said bottom portion having a substantially hollow interior, and said top portion dimensioned for receipt within said hollow interior of said bottom portion for storing a plurality of identical cots in nested stacked relation such that the bottom edges of said lower side wall portions of each stacked cot rest at least partially upon said shoulder of the cot below.

19. The cot of claim 18, further comprising at least one pair of aligned hand grips disposed on opposed sides of said body.

20. A cot, comprising:

an elongated substantially hollow single piece integral body comprising a self-supporting plastic material having a closed curve cross-sectional construction;

said body including a bottom portion having lower side wall portions with bottom edges adapted for abutment with a room floor;

said body including a top portion having upper side wall portions, said lower side wall portions intersecting said upper side wall portions at a shoulder extending at least partially around a perimeter of said body;

said upper side wall portions substantially surrounding a sleeping surface;

said bottom portion having a substantially hollow interior, and said top portion dimensioned for receipt within said hollow interior of said bottom portion for storing a plurality of identical cots in nested stacked relation such that the bottom edges of said lower side wall portions of each stacked cot rest at least partially upon said shoulder of the cot below.

* * * * *